US005353039A

United States Patent [19]

Tsukada et al.

[11] Patent Number: 5,353,039

[45] Date of Patent: Oct. 4, 1994

[54] VEHICLE REAR WINDOW GLASS ANTENNA FOR TRANSMISSION AND RECEPTION OF ULTRASHORT WAVES

[75] Inventors: Tokio Tsukada; Yoji Nagayama; Junichiro Ieiri, all of Matsusaka, Japan

[73] Assignee: Central Glass Company, Ube, Japan

[21] Appl. No.: 882,541

[22] Filed: May 13, 1992

[30] Foreign Application Priority Data

Jun. 28, 1991 [JP] Japan ..... 3-158710

[51] Int. Cl.[5] ..... H01Q 1/32; H01Q 9/38

[52] U.S. Cl. ..... 343/713; 343/846

[58] Field of Search ..... 343/713, 704, 846; H01Q 1/32, 1/38, 9/38

[56] References Cited

U.S. PATENT DOCUMENTS 4,721,964 1/1988 Sato et al. ..... 343/713

FOREIGN PATENT DOCUMENTS 3824417 1/1990 Fed. Rep. of Germany ..... 343/713
171202 8/1986 Japan ..... 343/713
244101 10/1986 Japan ..... 343/713
120903 5/1989 Japan ..... H01Q 1/32
8809569 12/1988 World Int. Prop. O. ..... H01Q 9/38

*Primary Examiner*—Michael C. Wimer
*Attorney, Agent, or Firm*—Keck, Mahin & Cate

[57] ABSTRACT

This invention provides a vehicle window glass antenna arranged in a space left below defogging heater strips for transmission and reception of ultrashort waves used for mobile phones and/or personal radios. The antenna section has a primary antenna which is a combination of a plurality of elongate elements connected to each other so as to form a closed plane figure having one to four vertexes each of which is acutely angled and pointed upward and becomes an upper end of the primary antenna. The plurality of elongate elements includes a single horizontally elongate element which becomes the bottom side of the plane figure. The antenna includes a secondary antenna section which is essentially a horizontally elongate element positioned below the primary antenna section. The antenna feeder is a coaxial cable, and the primary and secondary antenna sections are connected with the inner and outer conductors of the coaxial cable, respectively.

17 Claims, 4 Drawing Sheets

VEHICLE REAR WINDOW GLASS ANTENNA FOR TRANSMISSION AND RECEPTION OF ULTRASHORT WAVES

BACKGROUND OF THE INVENTION

This invention relates to an antenna, provided to a vehicle rear window glass, for transmitting and receiving ultrashort waves. The window glass is provided with defogging heater strips. The antenna is arranged in a space below the heater strips and constructed of a plurality of conductive strips attached to the window glass in a special pattern. The antenna is particularly suitable to mobile phones and/or personal radio transmitter-receivers installed on automobiles.

In current automobiles it is customary to use a pole antenna for the transmission and reception of ultrashort waves assigned to mobile phones and/or personal radios. However, the protrusion of a pole antenna from a car body is unfavorable for safety and also for good appearance of the car. Besides, pole antennas are obstructive to car washing and liable to break.

There are some proposals of providing an antenna for transmission and reception of ultrashort waves on an automobile window glass: for example, JP 62-69704 A and JP 62-26912 A (Utility Model). However, window glass antennas proposed until now are considerably low in transmission and reception gains compared with conventional pole antennas and hence cannot be put into practical use for car telephones or personal radios.

In the case of providing a window glass antenna for a mobile phone and/or a personal radio to an automobile rear window glass which is preferentially provided with defogging heater strips, it is usual to arrange the antenna within a space left below the heater strips, and according to general knowledge the window glass antenna needs to have a horizontally elongate element as an upper end part of the antenna. If that horizontal element of the antenna is close to the heater strip in the lowermost position, the influence of that heater strip on the horizontal antenna element causes lowering of the reception gain of the antenna, and hence it is desirable to keep a vertical distance of at least 40 mm between the horizontal antenna element and the lowermost heater strip. Actually, however, it is difficult to realize such spacing because, in order to secure the rear view of the driver, it is impermissible to reduce the defogging capability by enlarging the distance between the lowermost heater strip and the lower edge of the window glass.

SUMMARY OF THE INVENTION

It is an object of the present invention to provide a vehicle rear window glass antenna which is suited to automobiles, can be arranged in a space left below deforming heater strips and is capable of transmitting and receiving ultrashort waves assigned to mobile phones and personal radios with sufficiently high gains.

The present invention provides an antenna attached to a vehicle window glass, which is provided with a set of defogging heater strips which extend horizontally so as to leave a space between the lowermost heater strip and the lower edge of the window glass, for transmitting and receiving ultrashort waves, and particularly waves assigned to mobile phones and/or personal radios. According to the invention the antenna comprises a primary antenna section which is a combination of a plurality of elongate elements connected to each other so as to form a closed plane figure having at least one and not more than four vertexes, each of which is acutely angled and pointed upward and becomes an upper end of the primary antenna section. The elongate elements of the primary antenna section include a single horizontally elongate element which becomes the bottom side of the aforementioned plane figure. The antenna of the invention further comprises a secondary antenna section which is essentially a single horizontally elongate element which extends below the primary antenna and has a length in the range from 30 to 400 mm. As a feeder, the antenna employs a coaxial cable, and the primary antenna section is connected with the inner conductor of the coaxial cable whereas the secondary antenna section is connected with the outer conductor.

In this specification, the term "vertical" is used in the sense of "perpendicular to a horizontal plane or line". That is, a "vertical element" of any window glass antenna in this specification may not actually be vertical when the window glass is installed on a vehicle.

In an antenna according to the invention, no horizontally elongate element is employed in the upper end portion. Instead, the upper end portion of the antenna consists of at least one acutely angled part which is pointed upward and formed by the intersection of two elements, each of which makes an angle with a horizontal line. By such configuration of the upper end portion of the antenna, this invention has succeeded in avoiding the unfavorable influence of the heater strips, and particularly of the lowermost heater strip, on the performance of the antenna and in shortening the vertical distance between the lowermost heater strip and the upper end of the antenna to the extent of about 5–10 mm.

Mobile phones and personal radios on automobiles transmit and receive vertically polarized waves. Therefore, a vertical element is useful as an important element of an automobile window glass antenna for the operation of car telephones and/or personal radios, and it is favorable that the length of the vertical element is close to a resonance length, $\lambda.\chi/4$, where $\lambda$ is the wavelength of the wave to be transmitted and received, and $\chi$ is a wavelength shortening coefficient of the window glass (usually $\chi$ is about 0.6), and hence ranges from about 40 mm to 80 mm. However, in the case of a window glass antenna that is constructed of printed thin conductive strips having widths of only 0.5–1 mm, it is impossible to realize sufficiently high gains over a fairly wide range of frequency with such a vertical element alone.

According to the present invention, sufficiently high gains are realized over a fairly wide range of frequency by the employment of a unique primary antenna section which is in the form of a closed plane figure having at least one and not more than four vertexes, each of which is acutely angled and pointed upward at the upper end(s) thereof, and a horizontal element at the lower end. Further, this primary antenna section is combined with a secondary antenna section which is essentially a horizontally elongate element positioned below the primary antenna section. In this invention, a feeder for the window glass antenna is a standard coaxial cable. The primary antenna section is connected with the inner conductor of the coaxial cable and the secondary antenna section with the outer conductor, whereby the window glass antenna becomes an ungrounded antenna. This manner of connection contributes to impedance matching between the antenna and the coaxial cable, which is an unbalanced feeder system, and consequently produces the effect of reducing loss of the antenna and enhancing the transmission and reception gains of the antenna.

A window glass antenna according to the invention is fully practicable as a transmission and reception antenna for mobile phones and personal radios on automobiles using the 800–900 MHz band. It is also possible to use this window glass antenna for automobile telephones using a higher band of which the central frequency is 1.5 GHz. Besides, this antenna can be used for the reception of television broadcast waves in the UHF band.

DESCRIPTION OF THE PREFERRED EMBODIMENTS

Figure 1:
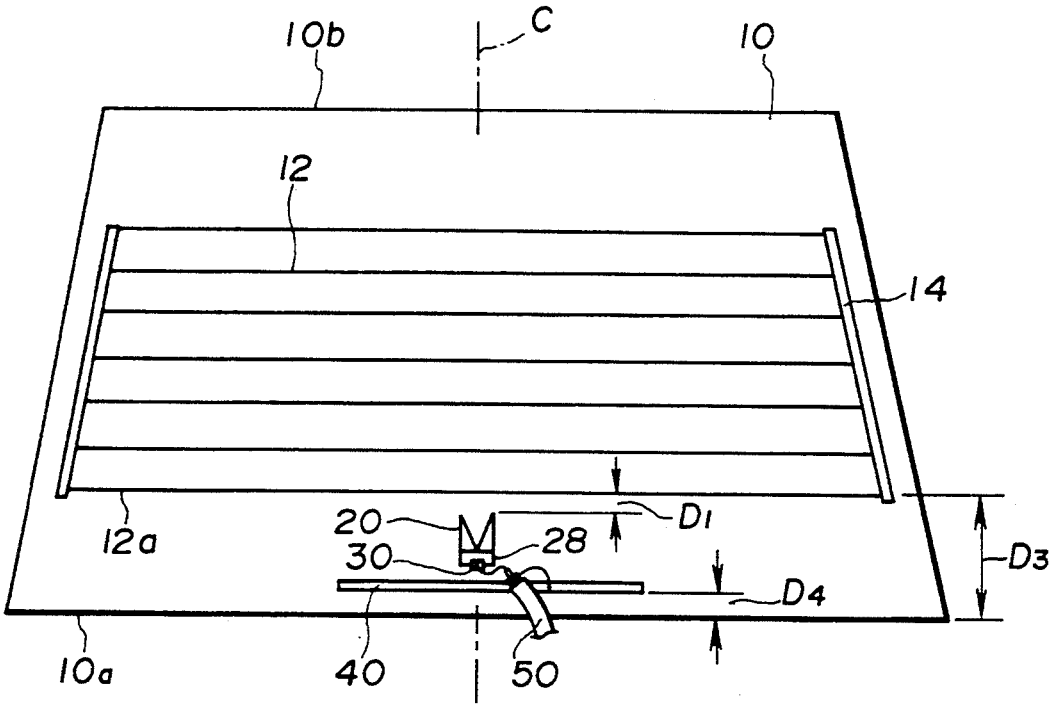
FIG. 1 is a plan view of an automobile rear window glass provided with an antenna according to the invention in a space below defogging heater strips.

FIG. 1 shows an automobile rear window glass in which the present invention is embodied. A single piece of glass plate 10 is used as the window glass. An array of defogging heater strips 12 is disposed on the inboard surface of the window glass 10 so as to leave an open space between the lower edge 10*a* of the glass 10 and a heater strip 12*a* in the lowermost position. The heater strips 12 extend horizontally and connect with a pair of bus bars 14.

Using the open space below the heater strips 12, an antenna according to the invention is disposed on the inboard surface of the window glass 10. Essentially, the antenna section is a combination of a primary antenna 20 and a secondary antenna section 40. The primary antenna section 20 is made up of a plurality of wire-like conductive strips and connected to a first feed point 30. The secondary antenna section 40 is a single conductive strip having some width, and it is positioned below the primary antenna section 20.

Usually, the elements of the primary and secondary antenna sections 20, 40 and the feed point 30, as well as the heater strips 12 and the bus bars 14, are formed by printing a conductive paste onto the glass surface and, after drying, baking the glass plate with the printed paste thereon. When the window glass 10 is a laminated glass pane, the antenna sections may be embedded in the laminated glass between one of the glass sheets and a plastic interlayer, or between two plastic interlayers, by using a thin wire or foil of a metal as the material of the antenna elements.

A coaxial cable 50 is used to connect the antenna to a transmitter-receiver (not shown) installed in the automobile. The coaxial cable 50 has an inner conductor (core) 52 and a tubular outer conductor 54 with an insulator (not shown) between the two conductors In the present invention, the inner conductor 52 is connected to the feed point 30, to which the primary antenna section 20 is connected, and the outer conductor 54 is connected to a second feed point 42 which is provided on the secondary antenna section 40. The outer conductor 54 is grounded at the chasis of the transmitter-receiver.

Figure 2:
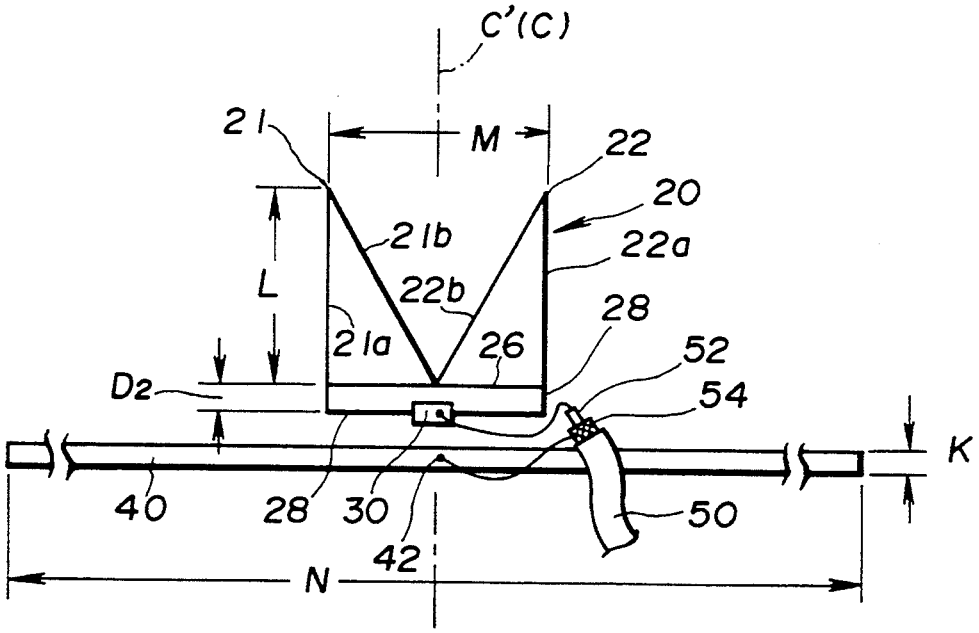
FIG. 2 is an enlarged view of the antenna in FIG. 1.

As shown in FIG. 2, the primary antenna section 20 has a combination of a vertical element 21*a* and an inclined element 21*b* intersecting each other to provide a vertex 21, a combination of another vertical element 22*a* and another inclined element 22*b* intersecting each other to provide another vertex 22 and a horizontal element 26 which connects the lower ends of the four elements 21*a*, 21*b*, 22*a*, 22*b* to each other. Both the two vertexes 21 and 22 are acutely angled and pointed upward, and these vertexes 21, 22 are the upper ends of the primary antenna section 20. In other words, this primary antenna section 20 makes two adjacent and symmetrical right-angled triangles. The first feed point 30 is located below the horizontal element 26, and the primary antenna section 20 is connected to this feed point 30 by a pair of connection lines 28.

In this embodiment, the vertical center axis C′ of the primary antenna section 20 is approximately on the vertical center axis C of the window glass 10. The horizontal secondary antenna section 40 is approximately bisected by the center axis C′. However, it is possible to shift the positions of the first and second antenna sections 20, 40 to the right or to the left. The influence of the heater strips 12 on the performance of the antenna becomes almost negligible when the primary antenna section 20 is positioned at a vertical distance, $D_1$ in FIG. 1, of at least 5 mm and preferably not shorter than 10 mm from the lowermost heater strip 12*a*. For high reception gains of the antenna, it is suitable to arrange the primary antenna section 20 within a square or rectangular area ranging from 40 to 80 mm in horizontal width and from 40 to 80 mm in length perpendicular to the width. That is, in the embodiment shown in FIGS. 1 and 2 it is suitable that the width M and length L of the primary antenna section 20 are, respectively, from 40 to 80 mm.

In this embodiment, the primary antenna section 20 has two upwardly pointed vertexes 21 and 22 in the upper end portion. The number of such vertexes can be chosen within the range from 1 to 4. If the upper end part of the primary antenna section has more than four vertexes, the antenna becomes relatively low in reception gain. In most cases, it is suitable to form 1 to 3 vertexes in the upper end part of the primary antenna section. The elongate elements used to form the respective vertexes, such as the elements 21*a*, 21*b*, 22*a*, 22*b* in FIG. 2, are not necessarily accurately linear elements and may be slightly curved elements. Each of the vertexes (21, 22) in the upper end part is not necessarily sharply pointed and may be rounded insofar as the radius of curvature is smaller than about 5 mm.

The secondary antenna section 40 has a horizontal length in the range from 30 to 400 mm, and preferably in the range from 100 to 300 mm. Preferably the secondary antenna section 40 is positioned at a vertical distance of at least 10 mm from the lower edge 10*a* of the window glass and at a distance of 2–30 mm from the first feed point 30 for the primary antenna section 20. If it is difficult or inconvenient to space the first feed point 30 from the secondary antenna section 40, the width (K in FIG. 2) of the belt-like secondary antenna section 40 may be locally reduced so as to provide a space for an end part of the feed point 30 and thereby keep a distance of at least 2 mm between the feed point 30 and the secondary antenna section 40. In the embodiment shown in FIGS. 1 and 2 the second feed point 42, i.e., a terminal for electrical connection, is provided on the belt-like secondary antenna section 40, but this is not essential. In practice, it will be more convenient to provide an electrical terminal to the outer conductor 54 of the coaxial cable 50 and, in that case, it suffices to extend a lead wire from the secondary antenna section 40 to the electrical terminal of the coaxial cable.

In a sample of the window glass shown in FIGS. 1 and 2, the glass plate 10 was 1330 mm in the length of the lower edge 10*a*, 1120 mm in the length of the upper edge 10*b* and 750 mm in the length perpendicular to the upper and lower edges, and the distance $D_3$ of the array of heater strips 12 from the lower edge 10*a* was 105 mm. The dimensions of and relating to the antenna elements were as follows.

The primary antenna section 20 was 60 mm in width M and 50 mm in length L and at a vertical distance $D_1$ of 20 mm from the lowermost heater strip 12*a*. The first feed point 30 was at a vertical distance $D_2$ of 7.5 mm from the horizontal element 26 of the primary antenna section 20. As to the secondary antenna section 40, the length N was 300 mm, and the width K was 5 mm, and the distance $D_4$ from the lower edge 10*a* of the glass 10 was 16 mm.

With this sample, gains of the antenna in transmitting and receiving radio waves in the 800–900 MHz band, which is used for automobile telephones in the United States and Canada, as vertically polarized waves were measured and compared with gains of a conventional standard pole antenna for automobile telephones. That is, for any frequency, the gain of the pole antenna was taken as the basis, 0 dB, and the gain of the sample antenna was marked on this basis. The results are shown in Table 1.

TABLE 1

| Frequency (MHz) | Gain (dB) |
|---|---|
| 800 | −4.2 |
| 810 | −3.4 |
| 820 | −1.9 |
| 830 | −2.5 |
| 840 | −4.5 |
| 850 | −5.0 |
| 860 | −0.9 |
| 870 | −0.5 |
| 880 | +0.2 |
| 890 | +0.5 |
| 900 | +0.1 |
| average | −2.0 |

From the data in Table 1, the window glass antenna of FIGS. 1 and 2 can be judged to be sufficiently efficient and almost comparable to the pole antenna which has been in practical use.

When the same sample antenna was used for the transmission and reception of vertically polarized waves for personal radios at a center frequency of 904 MHz, an average gain (vs. a half-wave dipole antenna) was −0.2 dB. Since conventional pole antennas for automobiles are nearly equivalent to the half-wave dipole antenna in respect of transmission and reception gains, the tested window glass antenna is regarded as nearly equivalent to the conventional pole antennas.

Furthermore, the same sample antenna was tested as an antenna for the reception of TV broadcast waves in the UHF band of 470–770 MHz with respect to both horizontal polarization and vertical polarization, and it was evidenced that with this window glass antenna it is possible to receive UHF TV broadcasting.

Figure 3:
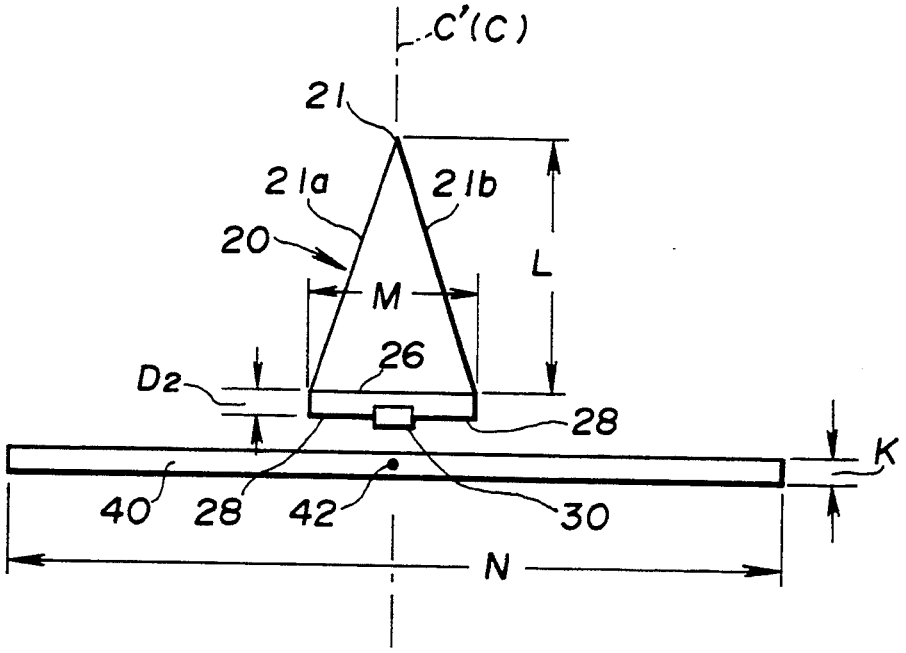
FIGS. 3 to 6 show four different modifications of the antenna of FIG. 2, respectively.

FIG. 3 shows another embodiment of the invention wherein the primary antenna section 20 is in the simplest shape. That is, the primary antenna section 20 consists of two symmetrically inclined elements 21*a* and 21*b* which intersect each other to form an acutely angled vertex 21 and a horizontal element 26 which connect the lower ends of the two inclined elements 21*a* and 21*b* to each other. The three elements 21*a*, 21*b*, 26 make the perimeter of an isosceles triangle.

In a sample of the antenna of FIG. 3, the primary antenna section 20 was 45 mm in width M and 60 mm in length L, and the distance $D_2$ of the feed point 30 from the bottom of the primary antenna section 20 was 8 mm. The secondary antenna section 40 was 200 mm in length N and 4 mm in width K.

Figure 4:
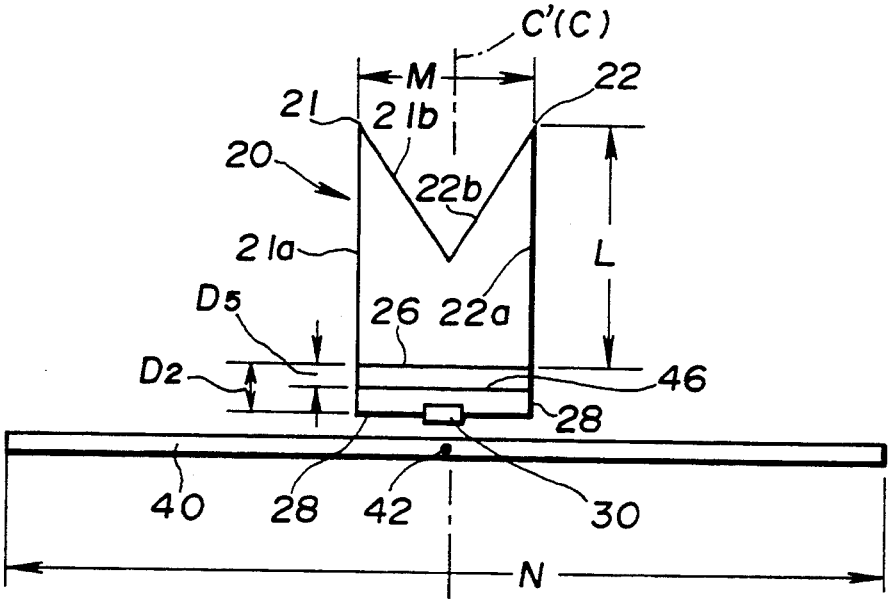

FIG. 4 shows a modification of the antenna shown in FIG. 2. First, the two vertical elements 21*a* and 22*a* are made longer than the inclined elements 21*b* and 22*b* so that the combination of the four elements 21*a*, 21*b*, 22*a*, 22*b* has the shape of the character M. There is no difference in that the horizontal element 26 connects the lower ends of the two vertical elements 21*a* and 22*a* to each other. Besides, the antenna of FIG. 4 includes an auxiliary element 46, which is an elongate element extending below and parallel to the horizontal element 26 of the primary antenna section 20. The auxiliary element 46 is connected with the primary antenna section 20 by the connection lines 28.

In a sample of the antenna section of FIG. 4 the primary element 20 was 50 mm in width M and 65 mm in length L. The distance $D_2$ of the feed point 30 from the bottom (26) of the primary antenna section 20 was 6 mm, and the auxiliary element 46 was at a vertical distance $D_5$ of 3 mm from the bottom (26) of the primary antenna section 20. The secondary antenna section 40 was 250 mm in length N.

Figure 5:
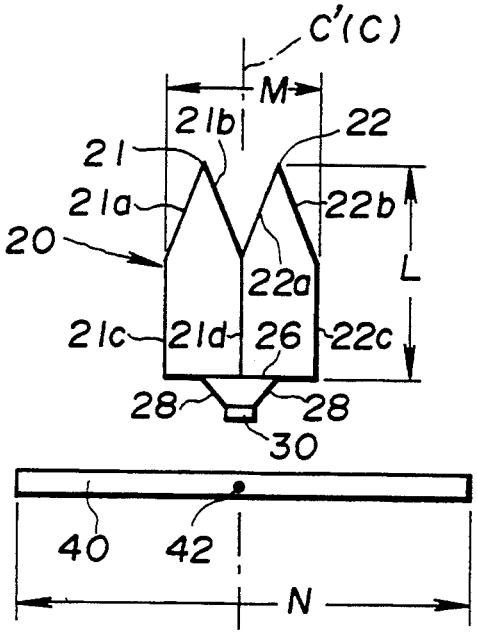

FIG. 5 shows a different configuration of the primary antenna section 20. In this case, the primary antenna section 20 makes two adjacent pentagons each of which has a rectangular lower part and a triangular upper part. There are three vertical elements 21*c*, 21*d* and 22*c* arranged parallel to each other. Two symmetrically inclined elements 21*a* and 21*b* extend from the upper ends of the two vertical elements 21*c* and 21*d*, respectively, and intersect each other to provide an acutely angled vertex 21, and two symmetrically inclined elements 22*a* and 22*b* extend from the top ends of the two vertical elements 21*d* and 22*c*, respectively, and intersect each other to provide another acutely angled vertex 22. The horizontal element 26 connects the lower ends of the three vertical elements 21*c*, 21*d*, 22*c* to each other. In this example the primary antenna section 20 is connected to the feed point 30 by two connection lines 28 which extend obliquely downward from the horizontal element 26.

In a sample of the antenna of FIG. 5 the primary antenna section 20 was 50 mm in width M and 65 mm in length L. The secondary antenna section 40 was 150 mm in length N.

Figure 6:
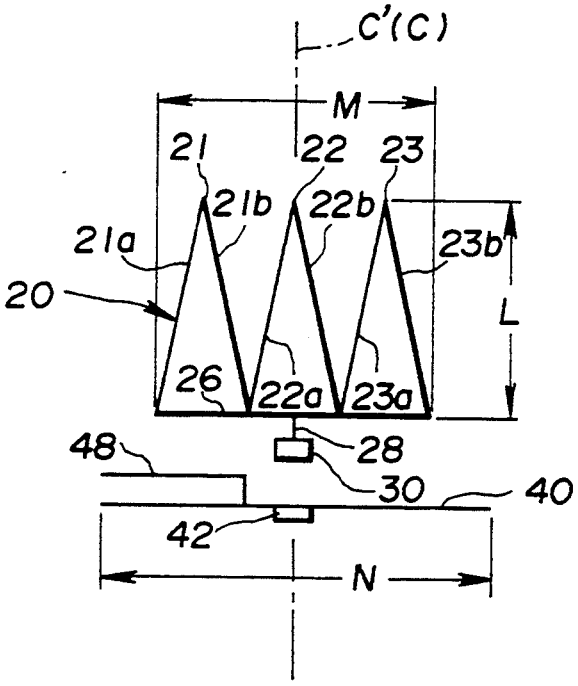

FIG. 6 shows another embodiment of the invention. In this case the primary antenna section 20 makes the perimeters of three isosceles triangles which are arranged in a row and, hence, has three acutely angled vertexes 21, 22 and 23 in the upper end part. The vertex 21 is provided by the intersection of two symmetrically inclined elements 21*a* and 21*b*, the vertex 22 by the intersection of two symmetrically inclined elements 22*a* and 22*b*, and the vertex 23 by the intersection of two symmetrically inclined elements 23*a* and 23*b*. The horizontal element 26 becomes the bottom sides of the three triangles. This primary antenna section 20 is connected to the feed point 30 by a single connection line 28 which extends downward from the middle of the horizontal element 26.

In the antenna section of FIG. 6 the secondary antenna 40 is a thin, wire-like strip and accordingly, a feed point 42 for the secondary antenna section 40 is formed adjacent to the antenna section 40. As a further modification, an auxiliary element 48 is connected to the secondary antenna section 40. The auxiliary element 48 is located below the primary antenna section 20 and above the secondary antenna section 40 and extends horizontally.

In a sample of the antenna of FIG. 6, the primary antenna section 20 was 75 mm in width M and 50 mm in length L. The secondary antenna section 40 was 100 mm in length N, and the auxiliary element 48 had a horizontal length of 40 mm.

Each of the aforementioned samples of the antennas of FIGS. 3, 4, 5 and 6 was provided to the window glass 10 of the same dimensions as the window glass of the sample of the window glass antenna of FIG. 1 and, except for the changes mentioned hereinbefore, the dimensions of and relating to the antenna elements were the same as in the sample of the antenna shown in FIGS. 1 and 2. With respect to the samples of the antennas of FIGS. 3, 4, 5 and 6, Table 2 shows gains (vs. pole antenna) in transmitting and receiving vertically polarized waves in the 800–900 MHz band.

TABLE 2

| Frequency (MHz) | Gain (dB) | | | |
|---|---|---|---|---|
| | Antenna of FIG. 3 | Antenna of FIG. 4 | Antenna of FIG. 5 | Antenna of FIG. 6 |
| 800 | −6.4 | −5.6 | −4.9 | −2.3 |
| 810 | −5.1 | −6.7 | −6.2 | −5.7 |
| 820 | −3.4 | −3.1 | −2.2 | −5.6 |
| 830 | −4.2 | −2.3 | −2.3 | −5.1 |
| 840 | −2.0 | −2.9 | −3.0 | −4.4 |
| 850 | −3.2 | −2.0 | −1.9 | −2.3 |
| 860 | −0.5 | −1.9 | −1.4 | −1.3 |
| 870 | −1.9 | −2.8 | −2.9 | −2.5 |
| 880 | −1.2 | +0.1 | −0.2 | −0.5 |
| 890 | +0.5 | +0.8 | +0.3 | +0.1 |
| 900 | −0.4 | −1.1 | −2.2 | −0.4 |
| average | −2.1 | −2.5 | −2.4 | −2.8 |

Thus, any of the window glass antennas of FIGS. 3 to 6 is equivalent to or almost comparative to the antenna shown in FIGS. 1 and 2 and can be regarded as good and practicable antenna.

These sample antennas were further tested for the transmission and reception of vertically polarized for personal radios at a center frequency of 904 MHz. The performance of every antenna was good and nearly equivalent to that of the sample antenna of FIG. 1. That is, average gain (vs. a half-wave dipole antenna) was −0.8 dB with the sample antenna of FIG. 3, −1.4 dB with the sample antenna of FIG. 4, −2.6 dB with the sample antenna of FIG. 5 and −0.8 dB with the sample antenna of FIG. 6. Furthermore, by any of these sample antennas it was possible to receive TV broadcast waves in the UHF band of 470–770 MHz with respect to both horizontal polarization and vertical polarization.

An antenna according to the invention does not necessarily have antenna elements other than the primary and secondary antenna sections 20 and 40. However, according to the type of the car to which the invention is applied, it is optional to add an auxiliary antenna element, or auxiliary antenna elements, such as the element 46 in FIG. 4 and/or the element 48 in FIG. 6, for the purpose of enhancing the transmission and reception gains and/or improving the directional characteristics.

In the above described embodiments, an antenna according to the invention is provided in a central area of the horizontally elongate space between the heater strips 12 and the lower edge 10*a* of the window glass, but this is not limitative as mentioned hereinbefore. In some cases it will be desirable to shift the position of the antenna to the right or to the left. For instance, when it is required to install a so-called high-mount stop lamp in the central area of the space below the heater strips, the position of the antenna has to be shifted from the central area. Aside from the high-mount stop light, there is a possibility of providing one antenna set on the right-hand side of the window glass and another antenna set on the lefthand side with the intention of providing diverse reception. For some types of cars it will be convenient to position the feed points of the antenna in a lower corner region of the window glass.

Figure 7:
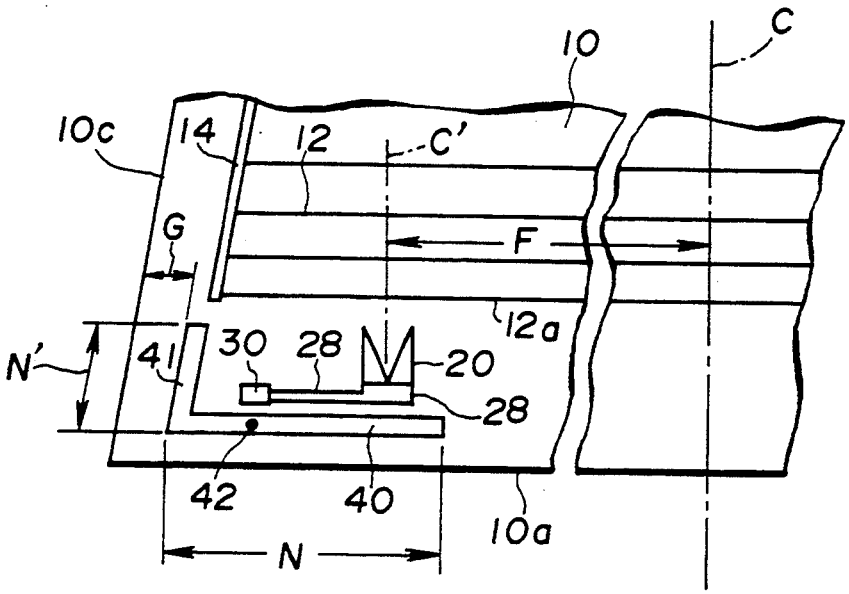
FIG. 7 shows a shift of the position of the antenna in FIG. 1 toward a side edge of the window glass with a minor change in the construction of the antenna.

For example, FIG. 7 shows a shift of the position of the antenna in FIG. 1. Within the horizontally elongate space along the lower edge 10*a* of the window glass, the primary antenna section 20 is shifted toward a side edge 10*c* of the window glass 10 to such an extent that the vertical center axis C′ of the antenna is at a horizontal distance F of 500 mm from the center axis C of the window glass. As shown in FIG. 7 the feed point 30 for connection of the primary antenna section 20 to the inner conductor of the coaxial cable may be positioned at a relatively short distance from the side edge 10*c* of the glass. The horizontal secondary antenna section 40 is also shifted toward the side edge 10*c*. It is permissible that the middle of the horizontal antenna section 40 deviates from the center axis C′ of the primary antenna section 20 toward the side edge 10*c*. In this example, the secondary antenna section 40 is supplemented with a linear element 41 which extends upward from one end of the horizontal antenna section 40 substantially parallel to the side edge 10*c* of the window glass.

In a sample of the antenna of FIG. 7, the dimensions of the primary antenna section 20 were the same as in the sample of the antenna of FIG. 1. The distance F was 500 mm. The secondary antenna section 40 was 125 mm in horizontal length N and 64 mm in the length N′ of the supplementary element 41, and the horizontal distance G of this element 41 from the side edge 10*c* of the glass was 20 mm. In the 800–900 MHz band, gains of the sample antenna (vs. pole antenna) in transmitting and receiving vertically polarized waves were as shown in Table 3. That is, the antenna of FIG. 7 is nearly equivalent to the antenna of FIG. 1.

TABLE 3

| Frequency (MHz) | Gain (dB) |
|---|---|
| 800 | −4.8 |
| 810 | −4.2 |
| 820 | −2.7 |
| 830 | −3.5 |
| 840 | −5.7 |
| 850 | −5.9 |
| 860 | −1.7 |
| 870 | −1.3 |
| 880 | −0.3 |
| 890 | +0.1 |
| 900 | −0.3 |
| average | −2.8 |

A vehicle rear window glass antenna according to the invention serves for practical purposes by itself. However, it is optional, and rather preferable in some cases, to construct a diversity antenna system by combining an antenna according to the invention with another window glass antenna, which is provided to the rear window glass, windshield or another window glass of the vehicle, or a conventional antenna such as a pole antenna.

What is claimed is:

1. An antenna attached to a vehicle rear window glass for receiving and transmitting ultrashort waves, the window glass being provided with a set of defogging heater strips each of which extends horizontally so as to leave a space between the lowermost heater strip and the lower edge of the window glass, the antenna being arranged in said space and comprising:

a primary antenna section which is a combination of a plurality of elongated elements connected to each other so as to form a closed plane figure having at least one and not more than four vertexes each of which is acutely angled and pointed upward and defines an upper end of the primary antenna section, and a plurality of elongated elements comprising a single horizontally elongated element which defines a bottom side of said closed plane figure;

a secondary antenna section comprising a single horizontally elongated element which extends below said primary antenna section and has a horizontal length in the range from 30 to 400 mm; and a feeder which is a coaxial cable having an inner conductor and an outer conductor with insulation therebetween, said primary antenna section being connected with said inner conductor and said secondary antenna section being connected with said outer conductor;

wherein said primary antenna section defines the perimeters of at least two triangles arranged in a row, said horizontally elongated element of the primary antenna section defining bottom sides of all of said at least two triangles.

2. An antenna according to claim 1, wherein said primary antenna section is arranged within a rectangular area ranging from 40 to 80 mm in horizontal width and from 40 to 80 mm in length perpendicular to the horizontal width.

3. An antenna according to claim 2, wherein a vertical center axis of the window glass passes through said rectangular area.

4. An antenna according to claim 2, wherein said rectangular area is horizontally distant from a vertical center axis of the window glass.

5. An antenna according to claim 1, wherein each of said vertexes of said primary antenna section is at a vertical distance of at least 5 mm from the lowermost heater strip.

6. An antenna according to claim 5, wherein said secondary antenna section is at a vertical distance of at least 10 mm from the lower edge of the window glass.

7. An antenna according to claim 1, wherein the horizontal length of said secondary antenna section is in the range from 100 to 300 mm.

8. An antenna according to claim 1, wherein said at least two triangles are identical in shape and size.

9. An antenna according to claim 1, wherein said at least two triangles are isosceles triangles.

10. An antenna according to claim 1, wherein said at least two triangles are symmetrical with respect to a vertical line.

11. An antenna according to claim 10, wherein each of said two triangles is a right-angled triangle having a vertical side extending upward from one end of said horizontally elongated element of the primary antenna section.

12. An antenna according to claim 1, further comprising an auxiliary antenna element which extends horizontally and is positioned below said primary antenna section and above said secondary antenna section.

13. An antenna according to claim 12, wherein said auxiliary antenna element is connected to said primary antenna section.

14. An antenna according to claim 12, wherein said auxiliary antenna element is connected to said secondary antenna section.

15. An antenna according to claim 1, wherein said secondary antenna section further comprises a supplementary element which is elongated and extends upward from one end of said horizontally elongated element of the secondary antenna section.

16. An antenna attached to a vehicle rear window glass for receiving and transmitting ultrashort waves the window glass being provided with a set of defogging heater strips each of which extends horizontally so as to leave a space between the lowermost heater strip and the lower edge of the window glass, the antenna being arranged in said space and comprising:

a primary antenna section which is a combination of a plurality of elongated elements connected to each other so as to form a closed plane figure having at least one and not more than four vertexes each of which is acutely angled and pointed upward and defines an upper end of the primary antenna section, and a plurality of elongated elements comprising a single horizontally elongated element which defines a bottom side of said closed plane figure;

a secondary antenna section comprising a single horizontally elongated element which extends below said primary antenna section and has a horizontal length in the range from 30 to 400 mm; and a feeder which is a coaxial cable having an inner conductor and an outer conductor with insulation therebetween, said primary antenna section being connected with said inner conductor and said secondary antenna section being connected with said outer conductor;

wherein said primary antenna section has a shape of a character M, said horizontally elongated element of the primary antenna section extending from the bottom end of one leg of the character M to the bottom end of the other leg of the character M.

17. An antenna attached to a vehicle rear window glass for receiving and transmitting ultrashort waves, the window glass being provided with a set of defogging heater strips each of which extends horizontally so as to leave a space between the lowermost heater strip and the lower edge of the window glass, the antenna being arranged in said space and comprising:

a primary antenna section which is a combination of a plurality of elongated elements connected to each other so as to form a closed plane figure having at least one and not more than four vertexes each of which is acutely angled and pointed upward and defines an upper end of the primary antenna section, and a plurality of elongated elements comprising a single horizontally elongated element which defines a bottom side of said closed plane figure;

a secondary antenna section comprising a single horizontally elongated element which extends below said primary antenna section and has a horizontal length in the range from 30 to 400 mm; and a feeder which is a coaxial cable having an inner conductor and an outer conductor with insulation therebetween, said primary antenna section being connected with said inner conductor and said secondary antenna section being connected with said outer conductor;

wherein said primary antenna section defines the perimeters of two adjacently arranged pentagons each of which consists of a rectangular lower part and a triangular upper part, said horizontally elongated element of the primary antenna section defining bottom sides of both of the two pentagons.

* * * * *